US011590558B2

(12) United States Patent
Honsa et al.

(10) Patent No.: US 11,590,558 B2
(45) **Date of Patent: *Feb. 28, 2023**

(54) END EFFECTOR

(71) Applicant: Honsa Ergonomic Technologies, Inc., Milan, IL (US)

(72) Inventors: Thomas W. Honsa, Milan, IL (US); Richard Borcicky, Battleboro, NC (US); Brett A. Casper, Rock Island, IL (US)

(73) Assignee: Honsa Ergonomic Technologies, Inc., Milan, IL (US)

( * ) Notice: Subject to any disclaimer, the term of this patent is extended or adjusted under 35 U.S.C. 154(b) by 204 days.

This patent is subject to a terminal disclaimer.

(21) Appl. No.: 17/094,480

(22) Filed: Nov. 10, 2020

(65) Prior Publication Data

US 2021/0053104 A1 Feb. 25, 2021

Related U.S. Application Data

(63) Continuation of application No. 16/247,541, filed on Jan. 14, 2019, now Pat. No. 10,828,692, which is a (Continued)

(51) Int. Cl.

| | |
|---|---|
| ***B21J 15/36*** | (2006.01) |
| ***B21J 15/02*** | (2006.01) |
| ***B21J 15/40*** | (2006.01) |

(52) U.S. Cl.

CPC ..... *B21J 15/36* (2013.01); *B21J 15/02* (2013.01); *B21J 15/40* (2013.01); *Y10T 29/53774* (2015.01)

(58) Field of Classification Search

CPC ... B21J 15/42; B21J 15/40; B21J 15/20; B21J 15/10; B21J 15/02; B21J 15/36; B21J 11/007

See application file for complete search history.

(56) References Cited

U.S. PATENT DOCUMENTS

| | | | |
|---|---|---|---|
| 1,156,142 | A | 10/1915 | Hughes |
| 1,179,839 | A | 4/1916 | Kamosis |

(Continued)

FOREIGN PATENT DOCUMENTS

| | | | |
|---|---|---|---|
| DE | 612224 | | 4/1935 |
| GB | 2492578 | A | 1/2013 |

(Continued)

OTHER PUBLICATIONS

International Search Report and Written Opinion for PCT/US2014/025125, dated Jul. 17, 2014.

*Primary Examiner* — Tyrone V Hall, Jr.

(74) *Attorney, Agent, or Firm* — Hamilton IP Law, PC; Jay R. Hamilton; Charles A. Damschen

(57) ABSTRACT

One illustrative embodiment of an end effector generally comprises a tip, a housing, and a main insert. The housing may include a housing neck, one or more housing sections, and an end section. A main insert may be positioned within the housing. One or more intermediate inserts may also be positioned in the housing, as may an end insert. During use, it is contemplated that the end effector will provide a user a more ergonomic and comfortable experience, requiring less effort from the user resulting in a less fatigue during use. Additionally, the illustrative embodiments of the end effector may be adjusted for optimal use in an infinite number of applications. Additionally, the locator ensures that the user properly locates the distal end of a rivet to create a uniform nugget as the distal end of the rivet is spread.

14 Claims, 10 Drawing Sheets

Related U.S. Application Data continuation of application No. 14/207,589, filed on Mar. 12, 2014, now Pat. No. 10,179,361.

(60) Provisional application No. 61/906,268, filed on Nov. 19, 2013, provisional application No. 61/777,070, filed on Mar. 12, 2013.

(56) References Cited

U.S. PATENT DOCUMENTS

| | | | |
|---|---|---|---|
| 1,441,117 | A | 1/1923 | John |
| 2,183,543 | A | 12/1939 | Cherry |
| 2,310,625 | A | 2/1943 | Fischer |
| 2,430,532 | A | 11/1947 | W |
| 2,576,786 | A | 11/1951 | Gray |
| 2,744,718 | A | 5/1956 | Markowski |
| 2,925,748 | A | 2/1960 | Ross |
| 3,085,217 | A | 4/1963 | Boode et al. |
| 3,695,499 | A | 10/1972 | Taylor |
| 3,724,738 | A | 4/1973 | Hurst |
| 4,170,920 | A | 10/1979 | Siebol |
| 4,218,911 | A | 8/1980 | Johnston |
| 4,493,205 | A | 1/1985 | Ramey |
| 4,562,948 | A | 1/1986 | Floyd |
| 4,635,732 | A | 1/1987 | Gotsch et al. |
| 4,709,841 | A | 12/1987 | Wollar |
| 4,885,836 | A | 12/1989 | Bonomi et al. |
| 4,955,119 | A | 9/1990 | Bonomi et al. |
| 4,995,148 | A | 2/1991 | Bonomi et al. |
| 5,299,464 | A | 4/1994 | Bennett |
| 5,357,666 | A | 10/1994 | Dessouky et al. |
| 5,771,551 | A | 6/1998 | Schurter et al. |
| 5,813,477 | A | 9/1998 | Clay et al. |
| 6,036,073 | A | 3/2000 | Newhouse |
| 6,092,964 | A | 7/2000 | Dessouky et al. |
| 6,192,997 | B1 | 2/2001 | Tsai et al. |
| 6,234,256 | B1 | 5/2001 | Kettner |
| 6,276,050 | B1 | 8/2001 | Mauer et al. |
| 6,668,942 | B1 | 12/2003 | Lin |
| 7,610,968 | B1 | 11/2009 | Honsa |
| 7,775,412 | B2 | 8/2010 | Nemeth |
| 10,828,692 | B2 * | 11/2020 | Honsa ..... B21J 15/02 |
| 2004/0034977 | A1 | 2/2004 | Heck et al. |
| 2004/0139590 | A1 | 7/2004 | Eldessouky |
| 2004/0223832 | A1 | 11/2004 | Aasgaard |
| 2006/0090318 | A1 * | 5/2006 | Toosky ..... B21J 15/043 29/243.518 |
| 2006/0218780 | A1 | 10/2006 | Lewis et al. |
| 2009/0031545 | A1 | 2/2009 | Keppel |
| 2010/0275424 | A1 | 11/2010 | Masugata |
| 2012/0267136 | A1 | 10/2012 | Mossnang |
| 2013/0167610 | A1 | 7/2013 | Sarh et al. |

FOREIGN PATENT DOCUMENTS

| | | | |
|---|---|---|---|
| JP | 05013640 | U | 2/1993 |
| KR | 1020090027763 | A | 3/2009 |

* cited by examiner

END EFFECTOR

CROSS REFERENCE TO RELATED APPLICATIONS

The present application is a continuation of U.S. patent application Ser. No. 16/247,541 filed on Jan. 14, 2019, now U.S. Pat. No. 10,828,692 issued Nov. 10, 2020, which application was a continuation of and claimed priority from U.S. patent application Ser. No. 14/207,589 filed on Mar. 12, 2014, now U.S. Pat. No. 10,179,361 issued Jan. 15, 2019, which claimed priority from U.S. Provisional Pat. App. No. 61/777,070 filed Mar. 12, 2013 and U.S. Provisional Pat. App. No. 61/906,268 filed Nov. 19, 2013, all of which are incorporated by reference herein in their entireties.

FIELD OF INVENTION

The present invention relates to hand tools, and more specifically, pneumatic and/or electric percussive tools and particularly to end effectors aka "bucking bars".

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND—RIVETS

By way of background and without limitation, the End Effector 10 disclosed may be used for the installation of rivets which are a permanent mechanical fastener. Before being installed, a rivet consists of a smooth cylindrical shaft with a head on one end. The end opposite the head is called the buck-tail. On installation the rivet is placed in a punched or drilled hole, and the tail is upset, or bucked (i.e., deformed), so that it expands to about 1.5 times the original shaft diameter, holding the rivet in place. To distinguish between the two ends of the rivet, the original head is called the factory head and the deformed end is called the shop head or buck-tail. Because there is effectively a head on each end of an installed rivet, it can support tension loads (loads parallel to the axis of the shaft); however, it is much more capable of supporting shear loads (loads perpendicular to the axis of the shaft). A flush rivet is used primarily on external metal surfaces (aka "work piece") where good appearance and the elimination of unnecessary aerodynamic drag are important. A flush rivet takes advantage of a countersink hole; they are also commonly referred to as countersunk rivets. Countersunk or flush rivets are used extensively on the exterior of aircraft for aerodynamic reasons. Additional post-installation machining may be performed to perfect the airflow. (As discussed in further detail at http://en.wikipedia.org/wiki/Rivet)

BACKGROUND—VIBRATION REDUCTION

Numerous studies of the vibration problem and attempted solutions thereto have been essayed, directed mainly to the provision of various forms of shock-absorbing materials interposed between the tool handle and the moving part of the tool. Typical of such part-solutions is the disclosure in U.S. Pat. No. 3,968,843 issued to Shotwell, wherein a block of rubber is disposed between the handle and barrel of a pneumatic percussion tool. Applicant has attempted other solutions to the vibration problem as disclosed in U.S. Pat. Nos. 4,648,468; 4,771,833; 4,905,772 5,027,910; 5,031,323; 5,054,562; 7,401,662; and, 7,610,968, all of which are incorporated by reference herein in their entireties.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION - LISTING OF ELEMENTS

Figure 1:
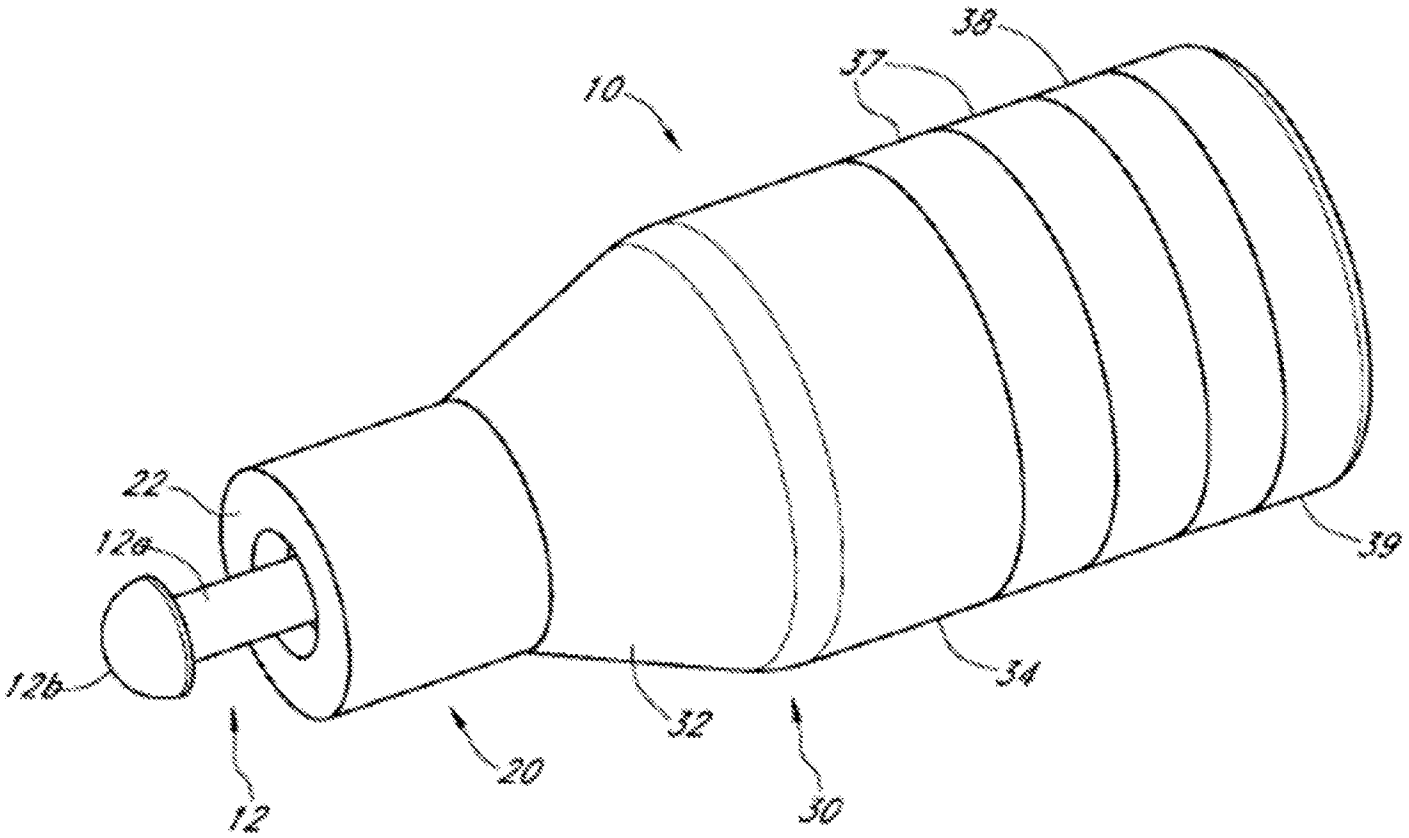
FIG. 1 provides a perspective view of a first embodiment of an end effector in accordance with the present disclosure.

| ELEMENT DESCRIPTION | ELEMENT # |
|---|---|
| End Effector | 10 |
| Rivet | 12 |
| Shaft | 12a |
| Head | 12b |
| Distal end | 12c |
| Work piece | 14 |
| Aperture | 15 |
| Biasing member | 16 |
| Tip | 20 |
| Ridge | 21 |
| Ramp | 21a |
| Work piece contact surface | 22 |

-continued

| DETAILED DESCRIPTION - LISTING OF ELEMENTS | |
|---|---|
| ELEMENT DESCRIPTION | ELEMENT # |
| Central bore | 24 |
| Fitting | 26 |
| Ledge | 26a |
| Second ledge | 26b |
| Locator | 28 |
| Housing neck | 30 |
| Neck first portion | 32 |
| Neck second portion | 34 |
| Annular ring | 35 |
| Neck bore | 36 |
| Bore shelf | 36a |
| Bore contour | 36b |
| Housing section | 37 |
| Lip | 37a |
| Groove | 37b |
| End section | 38 |
| End section seat | 38a |
| Cap | 39 |
| Main insert | 40 |
| Intermediate insert | 40a |
| End insert | 40b |
| Contact Insert | 41 |
| Insert neck | 42 |
| Shell | 43 |
| Annular groove | 44 |
| Cup | 46 |
| Cup wall | 46a |
| End insert external surface | 48 |
| Insert section seat | 48a |
| Bolt | 49 |
| Dolly | 50 |
| Bore | 51 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 provides a perspective view of a first illustrative embodiment of an end effector 10 (sometimes referred to as a "bucking bar" in reference to the installation of Rivets). Generally, it is contemplated that the end effector 10 may be used to spread the distal end 12*c* of the shaft 12*a* of a rivet 12 to form what is commonly referred to as a "nugget" or "butt," which may work in concert with a head 12*b* to retain the rivet 12 within an aperture in a work piece. The energy required to spread the distal end 12*c* of the rivet 12 is often provided via a pneumatic hammer or rivet gun (not shown) acting on the head 12*b*, but the scope of the end effector 10 as disclosed herein is not limited by the structure and/or method used to provide the energy required to spread the distal end 12*c* of the rivet 12. The end effector 10 subject of the present disclosure has been found to produce a desirable nugget or butt during installation of a rivet 12 and due to its superior ergonomic design, reduce the attendant stress upon the user of the end effector (not shown) delivered by the pneumatic hammer or rivet gun (not shown).

Generally, during use the tip 20 is positioned adjacent the rivet 12. A housing neck 30 may be engaged with the tip 20 at a first end of the housing neck 30. A housing section 37 may be engaged with the housing neck 30 opposite the tip 20, and one or more housing sections 37 may be positioned between the housing neck 30 and an end section 38. It is contemplated that a user will primarily grasp the end effector 10 about the housing neck 30, housing section(s) 37, end section 38, and/or cap 39 during use.

Figure 2:
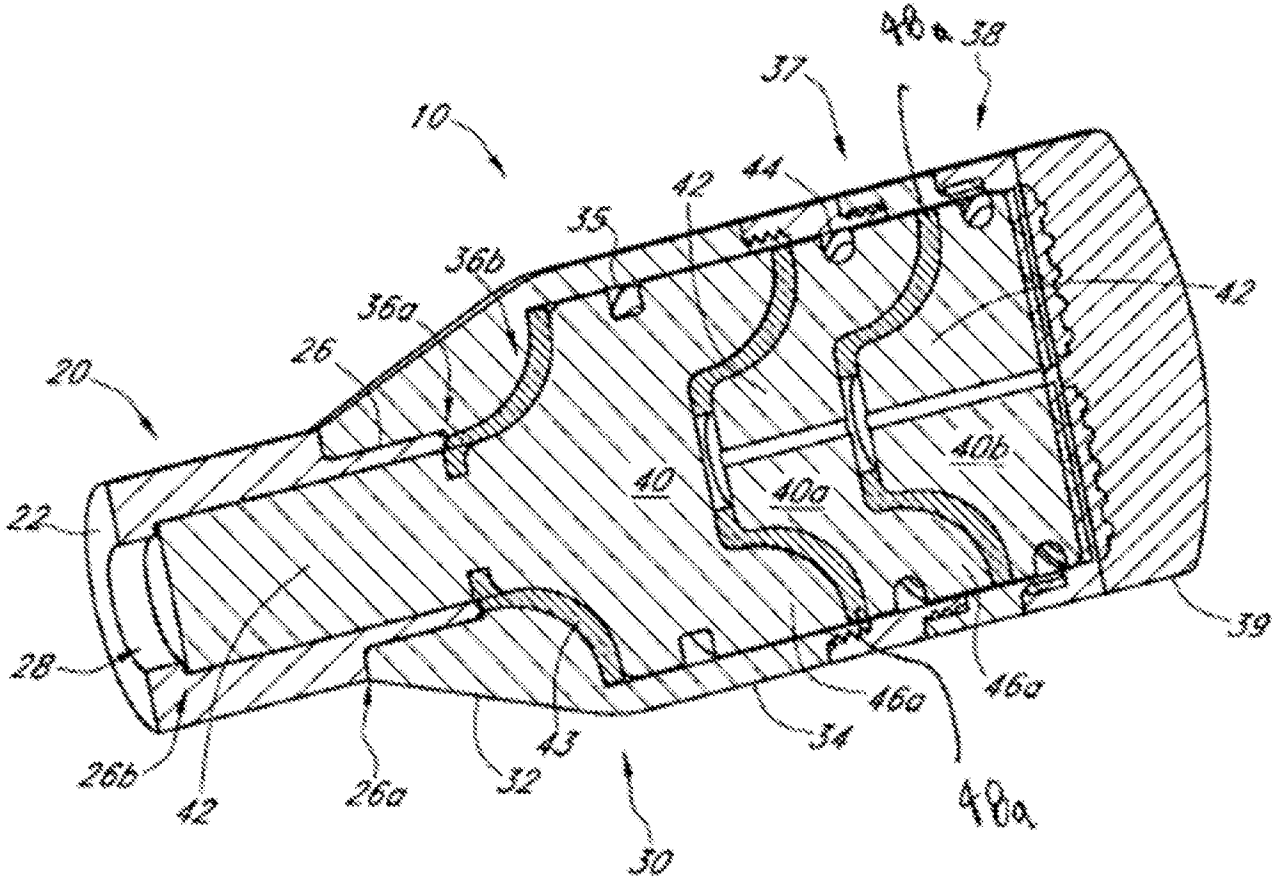
FIG. 2 provides a side, cross-sectional view of the first embodiment of an end effector in accordance with the present disclosure.
Figure 3:
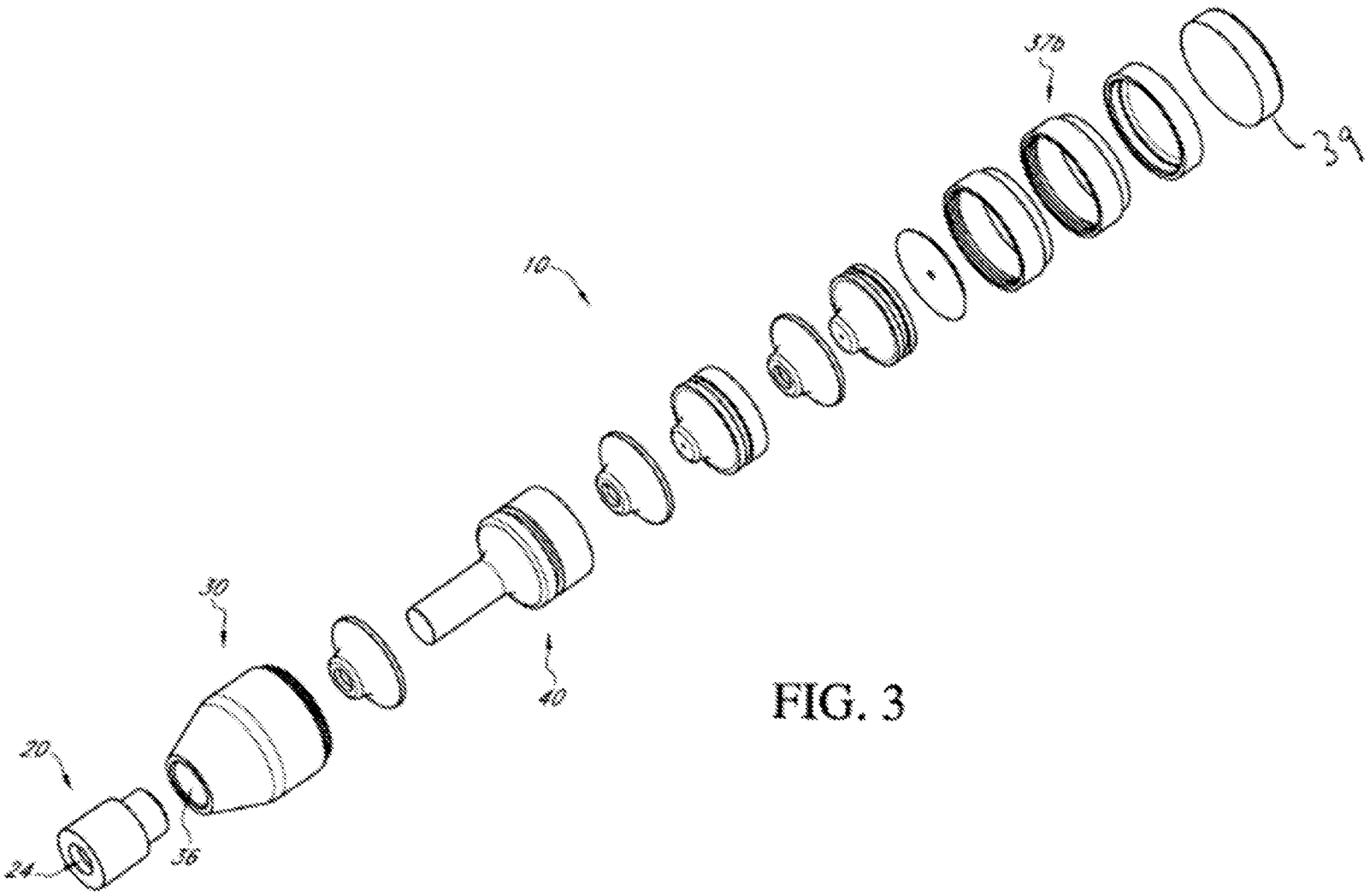
FIG. 3 provides a perspective, exploded view of the first embodiment of an end effector in accordance with the present disclosure.

Referring now to FIGS. 2 & 3, the tip 20 of the first illustrative embodiment of the end effector 10 may be configured with a central bore 24. A first end of the tip 20 may be configured with a work piece contact surface 22 generally shaped as a ring around the central bore 24, which may be designed to contact the work piece through which the rivet 14 passes. It is contemplated that the tip 20 may be constructed of a synthetic material designed not to mar or damage the surface of the work piece when the distal end 12*c* of the rivet 12 is spread. Accordingly, the optimal material will vary from one application of the end effector 10 to the next, and therefore is not limiting to the scope of the end effector 10. Additionally, the tip 20 may be configured so that it is transparent so that the user may see the engagement between the rivet 10 and the insert neck 42 of the main insert 40. Such a tip 20 may also be configured to magnify the rivet 12 to assist the user.

Materials used to construct the tip 20 include but are not limited to elastomeric polymers, cellulosic materials, and/or combinations thereof. When the work piece contact surface 22 is in contact with the work piece (not shown), it is contemplated that the end effector 10 will be configured such that a portion of the distal end 12*c* of the rivet 12 will be located within a portion of the central bore 24, as best shown in FIG. 2, which is referred to as a locator 28 and is described in more detail below.

The tip 20 may be engaged with a housing neck 30 about a fitting 26. The tip 20 may include a ledge 26*a*, which may be formed at the base of the fitting 26 to engage a neck first portion 32 of the housing neck 30. The tip 20 may also include a second ledge 26*b* formed in the central bore 24 intermediate with respect to the work piece contact surface 22 and the fitting 26 to engage a portion the main insert 40, as described in further detail below.

The housing neck 30 may include a neck second portion 34, which may be generally cylindrical in shape. The neck second portion 34 may be engaged with the neck first portion 32 as shown in FIGS. 1-3 and be configured with a neck bore 36 along the longitudinal axis thereof, which axis may be parallel to that of the central bore 24 of the tip 20. The configuration of the tip 20 as shown herein is for illustrative purposes only, and the scope of the end effector 10 is in no way limited to that as shown herein throughout the various figures. The internal surface of the housing neck 30 may be formed with a radiused bore contour 36*b* on the neck first portion 32 adjacent the bore shelf 36*a*. However, the scope of the housing neck 30 is not so limited and applies any configuration on the interior surface of the neck housing 30.

In the illustrative embodiments of the end effector 10, the tip 20 and housing neck 30 may be configured such that the fitting 26 of the tip 20 fits within the neck bore 30. In the illustrative embodiments, the fitting 26 and neck bore 30 may be generally cylindrical in shape, but the scope of the end effector 10 as disclosed and claimed herein is not so limited. The distal end of the fitting 26 may engage a bore shelf 36*a* formed in the neck bore 36 on the interior side of the neck bore 36 at the neck first portion 32. The distal end of the housing neck 30 may correspondingly engage the ledge 26*a* formed in the tip 20. The tip 20 may be engaged with the housing neck 30 thereby via an interference fit (aka "snap and click"). One of ordinary skill will appreciate the value and benefit of the snap and click attributes of the tip 20 as the modularity of the end effector 10 disclosed herein contemplates a large range of uses and sizes while still allowing secure engagement with the distal end of rivets 12, having variation in diameter and distal length, attributable as discussed further herein by the combination of the replaceable/swappable tip 20, the structure the of the locator 28 and the work piece contact surface 22 as well as the modular nature of the housing and housing sections as well as the main insert 40, intermediate insert 40*a*, end insert 40*b* and contact insert 41, to produce the rounded nugget or butt desired.

One of ordinary skill will also appreciate that although modularity of the housing and inserts and interchangeability of the tips is desirable, the present disclosure contemplates, without limitation or restriction the securing the tip 20 to the housing neck 30 using any suitable method and/or apparatus, including but not limited to screws, chemical adhesives, fasteners, and/or combinations thereof.

The terminal portion of the neck second portion 34 may be formed with a groove 37*b* therein for engagement with a housing section 37 or end section 38, as described in detail below. It is contemplated that a plurality of tips 20 having different configurations may be interchangeable with one another on a single end effector 10 and the tips 20 may have different dimensions, in both diameter and depth, as well as different configurations, to allow engagement with a range of rivets or other fasteners, having a range of sizes, as well as a range of work pieces having different requirements for work thereon.

A housing section 37 may be engaged with the housing neck 30 adjacent the neck second portion 34, as best shown in FIGS. 1&2, and/or adjacent housing sections 37 and/or an end section 38. Each housing section 37 may be formed with a lip 37*a* on a first end and a groove 37*b* on the second end such that the lip 37*a* from one housing section 37 fits into the groove 37*b* of an adjacent section. The lip 37*a* and groove 37*b* on adjacent housing sections 37 may have cooperating threads thereon to engage one another in a secure manner. Any structure and/or method may be used to engage one housing section 37 with another housing section 37, housing neck 30, and/or end section 38 without limitation. The first illustrative embodiment of the end effector 10 includes two housing sections 37 and one end section 38, but the number of housing sections 37 and/or end sections 38 in no way limits the scope of the end effector 10 as disclosed and claimed herein. Furthermore, the illustrative embodiments of the end effector 10 are designed to be modular, allowing the user to dictate the number of housing section 37, as further described below.

The end section 38 may be formed with a lip 37*a* around the periphery thereof. An end section seat 38*a* may be formed on the interior axial face of the end section 38. The end section seat 38*a* may be formed of an elastomeric polymer or other suitable material with suitable material characteristics for the specific application of the end effector 10. Alternatively, the end section seat 38*a* may be formed as a spring, or some other type of structure to absorb a specific amount of energy during spreading of the rivet 12 distal end 12*c*. A cap 39 may be formed on the exterior axial surface of the end section 38. The cap 39 may be formed of an elastomeric polymer or other suitable material with suitable material characteristics for the specific application of the end effector 10.

A main insert 40 may be positioned within the end effector 10, as best shown in FIG. 2. The main insert 40 may include an insert neck 42 extending down into the neck bore 36 and a portion of the central bore 24 of the tip 20. The axial face of the insert neck 42 of the main insert 40 may be configured to engage a rivet 12 at the distal end 12*c* thereof, as best shown in FIG. 2. A portion of the axial face of the insert neck 42 of the main insert 40 may also engage the second ledge 26*b*. A shell 43 may be configured to provide a buffer between a portion of the exterior of the main insert 40 and the bore contour 36*b*. The cap shell 43 may be formed of an elastomeric polymer or other suitable material with suitable material characteristics for the specific application of the end effector 10.

An intermediate insert 40*a* may be engaged with the main insert 40. The main insert 40 may be formed with a cup 46 near the center thereof opposite the axial surface adjacent the insert neck 42 of the main insert 40. A cup wall 46*a* may extend upward around the periphery of the cup 46. The intermediate insert 40*a* may be formed with an insert neck 42 that seats within the cup 46 of the main insert 40, as best shown in FIG. 2. The intermediate insert 40*a* may also include a cup 46 and cup wall 46*a*.

An end insert 40*b* may be engaged with an intermediate insert 40*a* or main insert 40. The end insert 40*b* may also be configured with an insert neck 42 that seats within the cup 46 of the intermediate insert 40*a* or main insert 40. The axial face of the end inserts 40*b* opposite the main insert 40 may be formed with an end section seat 38*a* thereon, as described in detail above for the end section 38. In the illustrative embodiments of the end effector 10, each intermediate insert 40*a* may correspond to a housing section 37, and the end insert 40*b* may correspond to an end section 38.

Figure 9:
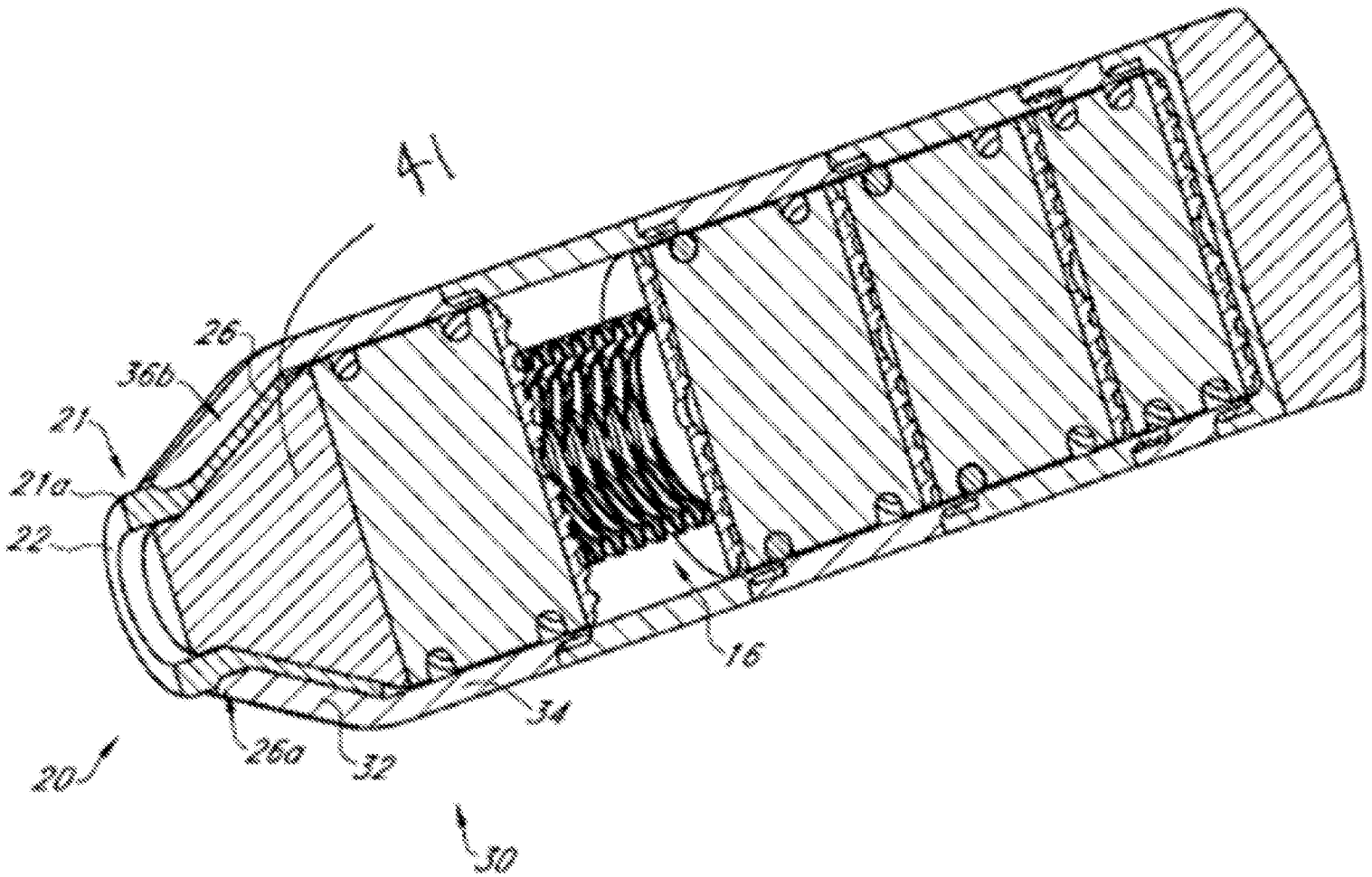
FIG. 9 provides a perspective view of another variation of the fourth embodiment of the end effector in accordance with the present disclosure wherein the contact insert is solid.

Each insert 40, 40*a*, 40*b* may be formed with an annular groove 44 therein. The annular groove 44 may cooperate with an annular ring 35 formed in the corresponding housing section 37, end section 38, and/or housing neck 30. These corresponding annular grooves 44 and annular rings 35 may serve to prevent binding between the relevant inserts 40, 40*a*, 40*b* and housing section 37, end section 38, and/or housing neck 30 during use of the end effector 10. As best shown by the illustrative figures included herein, each insert may be configured with a specific shape relative to its position in the housing (FIG. 2 main insert 40, intermediate 40*a*) or may be configured with a more generic, interchangeable shape (FIG. 9 insert 40).

The interaction and configuration between the fitting 26 and the bore shelf 36*a*, the configuration of the tip 20, and the length of the insert neck 42 may dictate the depth of the locator 28. The optimal dimensions of the locator 28 (i.e., the diameter of the central bore 24 along its length between the work piece contact surface 22 and the axial face of the insert neck 42) will vary from one application of the end effector 10 to the next, depending at least upon the size of the rivet 12, work piece material, and desired size of the resultant nugget. As stated above, it is contemplated that different tips 20 may be interchangeably used on a single end effector 10.

Figure 4A:
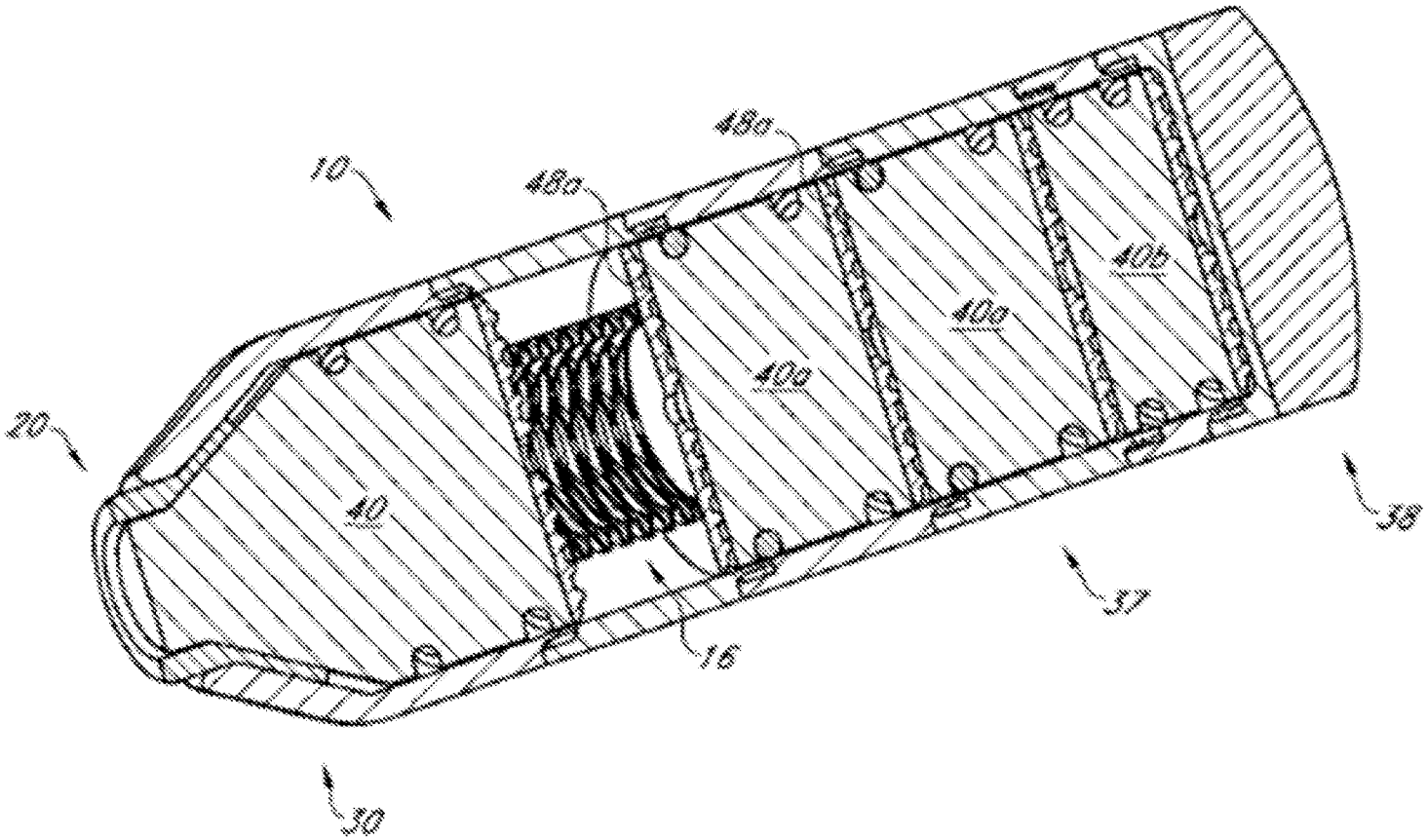
FIG. 4A provides a side, cross-sectional view of the second embodiment of an end effector in accordance with the present disclosure.
Figure 4B:
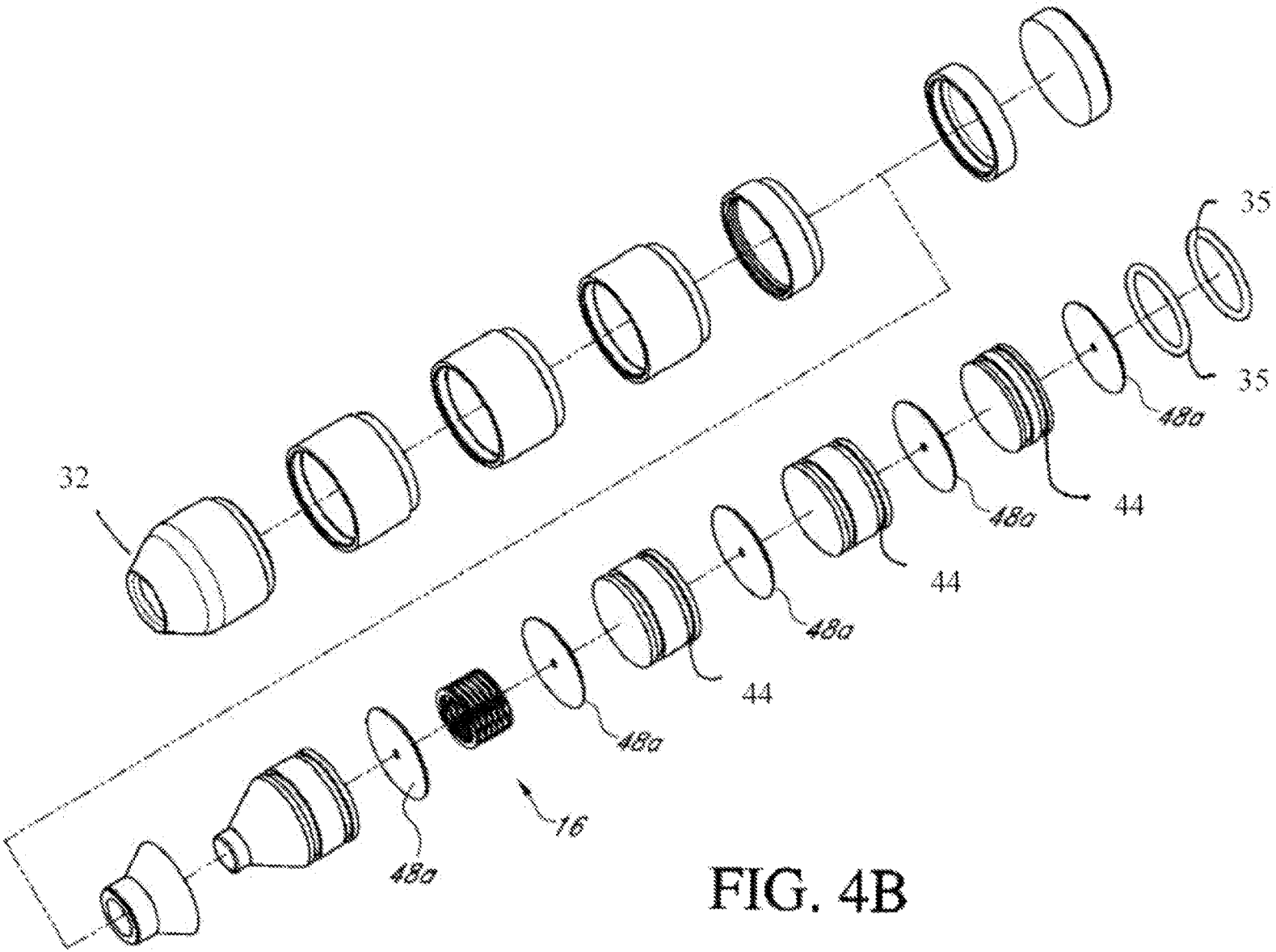
FIG. 4B provides a perspective, exploded view of the second embodiment of an end effector in accordance with the present disclosure.

A second illustrative embodiment of an end effector 10 is shown in axial cross-section in FIG. 4A and in an exploded, perspective view in FIG. 4B. The second illustrative embodiment of the end effector 10 may be configured and may function similarly to the first illustrative embodiment thereof as previously disclosed herein. The second illustrative embodiment of an end effector 10 may include a housing neck 30 and one or more housing sections 37 positioned between an end section 38, as previously described for the first illustrative embodiment of an end effector 10.

In any embodiment of an end effector 10, a biasing member 16 (such as a spring) may be encapsulated in the section seat 38*a*, insert section seat 48*a*, and/or other components. Alternatively, the end section seat 38*a*, insert section seat, and/or shell 43 could be formed as a wave spring or other energy absorbing and/or vibration damping structure. Specifically, in the second illustrative embodiment of an end effector 10, a biasing member 16 may be positioned between a main insert 40 and an intermediate insert 40*a*. However, as previously described, the biasing member 16 may be positioned at any place in the end effector 10 that will be advantageous for the specific application of the end effector 10.

An insert section seat 48*a* may be positioned between adjacent inserts 40, 40*a*, 40*b* as shown in FIGS. 4A & 4B. Additionally, insert section seats 48*a* may be positioned on an axial surface of an insert 40, 40*a*, 40*b* that engages the biasing member 16. In a manner similar to that described above for the end section seat 38*a*, an insert section seat 48*a* may be formed of an elastomeric polymer or other suitable material with suitable material characteristics for the specific application of the end effector 10.

Figure 5:
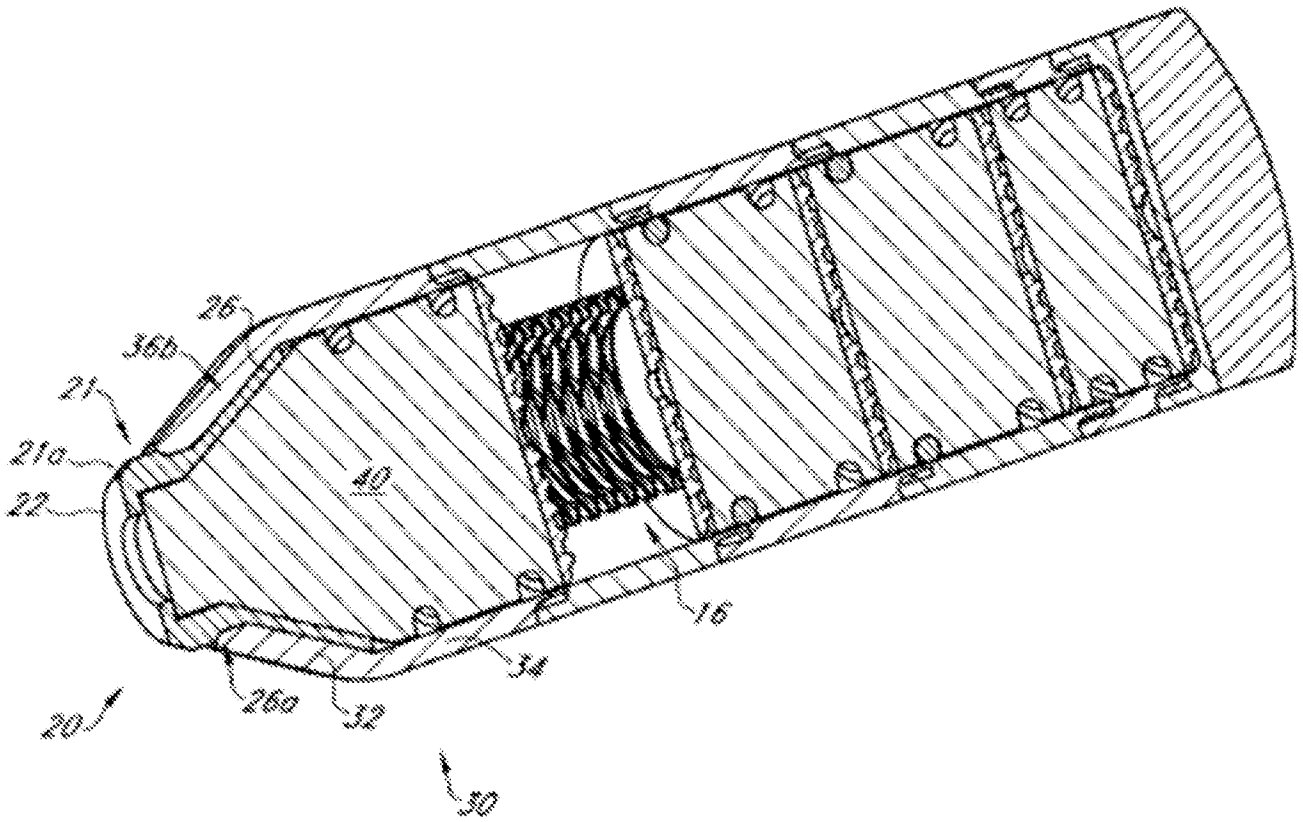
FIG. 5 provides a side, cross-sectional view of a third embodiment of an end effector in accordance with the present disclosure.

A third illustrative embodiment of an end effector 10 is shown in cross-section in FIG. 5. The third illustrative embodiment of an end effector 10 is similar to the second embodiment thereof (shown in FIGS. 4A & 4B), and those two illustrative embodiments generally function in the same manner. However, in the third illustrative embodiment, the tip 20 may be formed with a ridge 21 located between the work piece contact surface 22 and the ledge 26*a*. The ridge 21 may be formed with a ramp 21*a* on the distal edge thereof, as shown in FIG. 5.

The tip 20 in the third illustrative embodiment of an end effector 10 may be configured to facilitate engaging the tip 20 with the housing neck 30 via a snap-together arrangement. For example, the tip 20 may be positioned inside the housing neck 30 prior to assembly of the end effector 10. The tip 20 may be pressed toward the distal end of the housing neck 30 (i.e., in a direction from the neck second portion 34 toward the neck first portion 32 along the longitudinal axis of the housing neck 30). As this relative movement between the tip 20 and the housing neck 30 occurs, the ramp 21*a* formed on the leading edge of the ridge 21 encounters the interior surface of the housing neck 30 until the ridge 21 eventually passes through the neck bore 36 and emerges external to the neck housing 30. The bore contour 36*b* of the housing neck 30 and the fitting 26 of the tip 20 may be cooperatively frustum shaped, such that the fitting 26 seats within the bore contour 36*b*. A ledge 26*a* formed in the trailing edge of the ridge 21 may interface with an axial exterior face of the housing neck 30 to ensure that the tip 20 does not move relative to the housing neck in a direction away from the work piece contact surface 22 and toward the end section 38. From the present disclosure, those of ordinary skill in the art will appreciate that in any embodiment of the end effector 10, the tip 20 and housing neck 30 may be configured to cooperatively engage one another such that relative motion therebetween is allowed in certain circumstances (i.e., when assembling the end effector 10 and inserting the tip 20 through the housing neck 30), but not allowed in other circumstances (i.e., after the ramp 21 has passed through the neck bore 36 such that the ledge 26*a* engages an axial exterior face of the housing neck 30).

Figure 6:
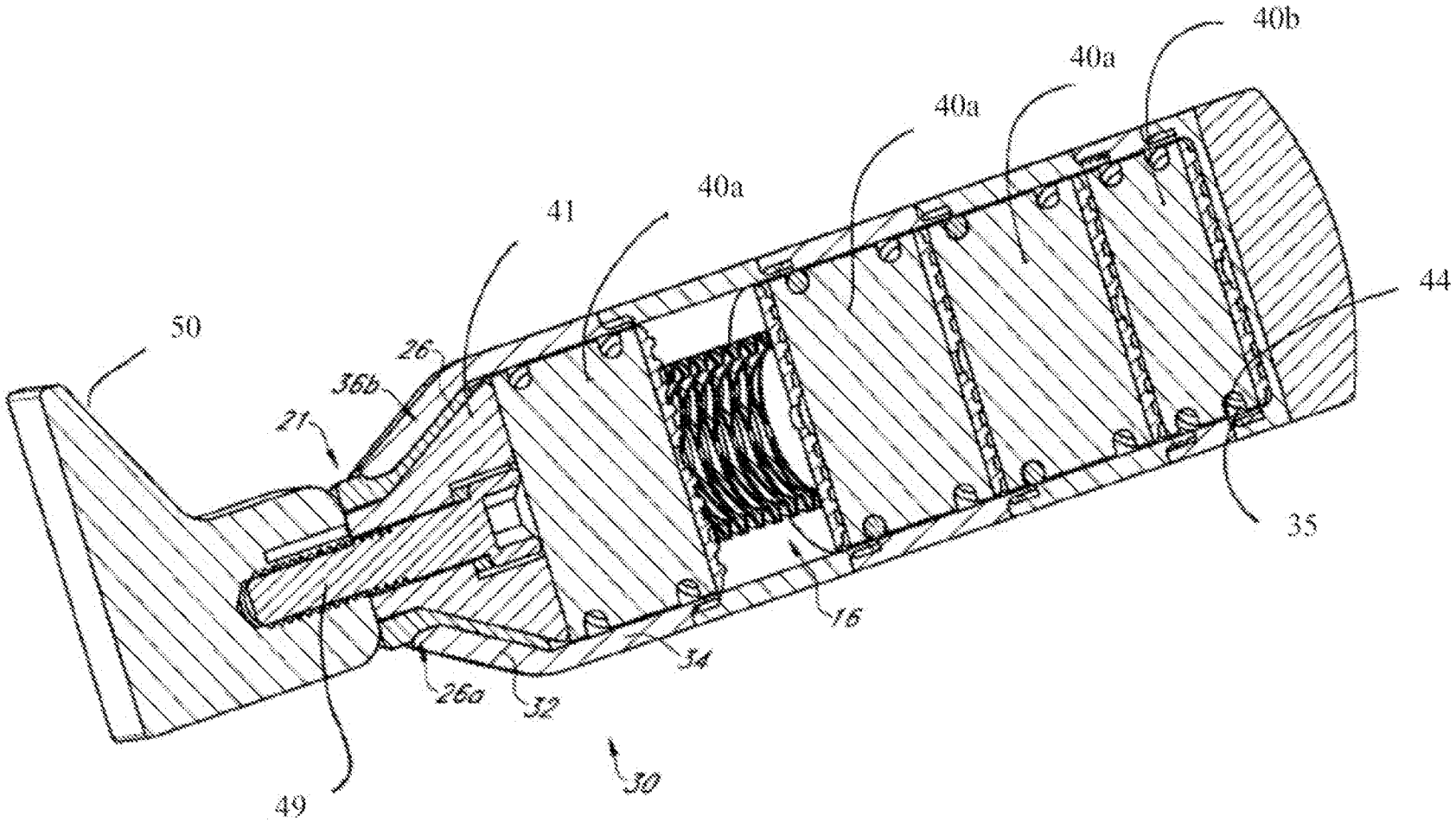
FIG. 6 provides a side, cross-sectional view of a fourth embodiment of an end effector in accordance with the present disclosure.
Figure 7:
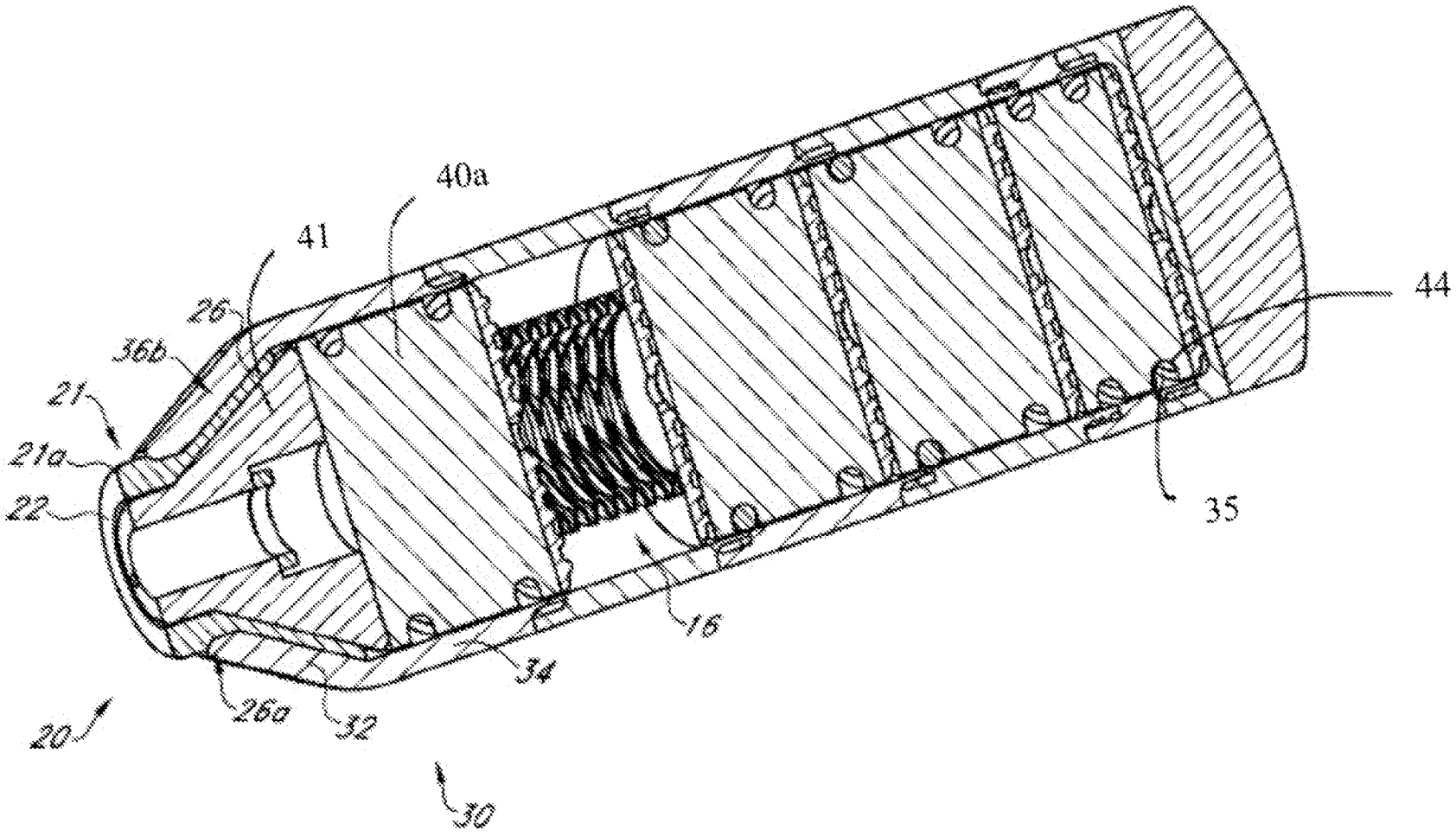
FIG. 7 provides a side, cross-sectional view of embodiment of FIG. 6 with the attachment bolt and dolly (foot) removed to better highlight the conical contact insert.
Figure 8:
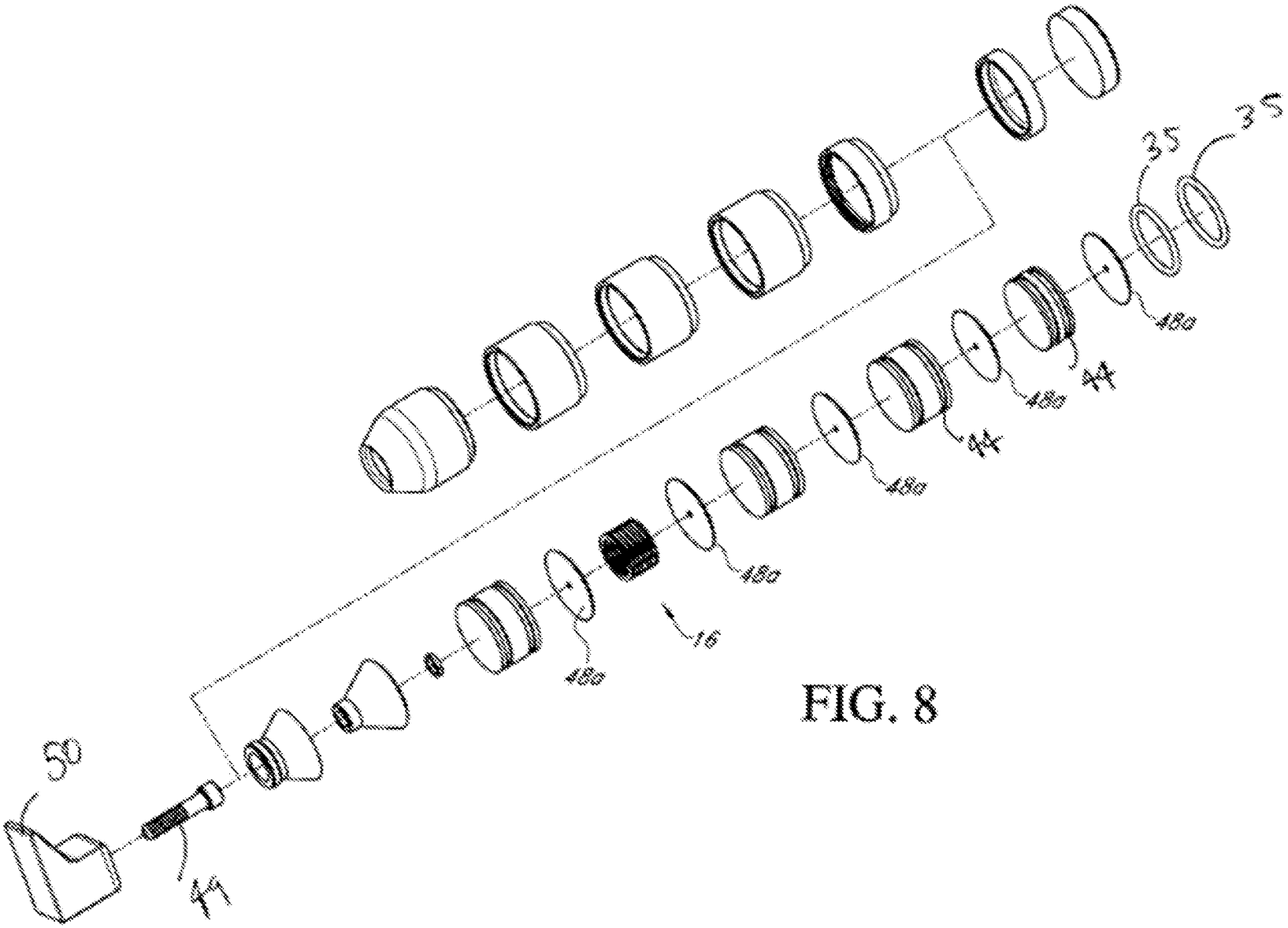
FIG. 8 provides a perspective, exploded view of the fourth embodiment of an end effector in accordance with the present disclosure.

FIG. 6 provides a side, cross-sectional view of a fourth embodiment of end effector 10. FIG. 7 provides a side, cross-sectional view of embodiment of FIG. 6 with the attachment bolt 49 and dolly (foot) 50 removed to better highlight the contact insert 41. As shown, contact insert may be configured with a bore 51. FIG. 8 provides a perspective, exploded view of the fourth embodiment of an end effector 10 in accordance with the present disclosure. As will be apparent, main insert 40 has been replaced with the contact insert 41, which has been configured to fit in the housing neck 30. The contact inserts 41 has been configured to allow a threads and insertion of a bolt 49. The dolly 50 attached to the end of the bolt 49 is an exemplary embodiment of a work piece contact surface 22 allowed by the interchangeability or removable/replacement of the tip 20. As shown in FIGS. 6-8, replacement of main insert 40 with contact insert 41 allows the remaining inserts (40*a*, 40*b*) positioned in the housing to be of similar shape and size to allow interchangeability, if desired.

Further, FIG. 9 provides a perspective view of another variation of the fourth embodiment of the end effector 10 wherein the contact inserts 41 is solid. As shown in FIG. 9, solid contact insert 41 is shown having a blunt nose and is fabricated from a durable material, such as steel, without limitation, to provide durability from direct and repeated engagement with the distal end of a rivet 12, for example. One of ordinary skill will appreciate that the length of the contact insert 41 may be lengthened or shortened to allow more or less engagement with more or less fastener or rivet. As discussed previously, and by way of illustration and without limitation, allows for interchangeable tip 20, with work piece contact surface 22, configured with the ridge 21 and ramp 21*a*, for engagement with ledge 26*a* and second ledge 26*b* of the interior of housing to removably lock the fitting 26 into the housing neck 30 to produce an ergonomic end effector 10 that via locator 28 aids in superior effectuation of the fastener, or production of the nugget if a rivet is acted upon. Further, variation in the size of the central bore and variation in the length of the tip 20, allows variation of the size of the contact insert 41 which allows for engagement with different fastener and rivet lengths as well as diameters, as desired, from a common end effector 10.

From the foregoing description, one of ordinary skill in the art will understand that the illustrative embodiments of the end effector 10 as disclosed herein are designed to be modular. That is, the user may determine the number of housing sections 37 and corresponding intermediate inserts 40*a*, which may range from zero to as many as needed for a specific application. The number of intermediate inserts 40*a* and housing sections 37 will affect at least the mass of the end effector 10, thereby allowing the user to adjust the physical characteristics of the end effector 10 for optimizing performance for different applications. That is, if more resistance is needed on the distal end 12*c* of the rivet 12, the user may increase the mass of the end effector 10 by adding intermediate inserts 40*a* and housing sections 37. Accordingly, the specific mass of any insert 40, 40*a*, 40*b* and/or housing section 37, end section 38, and/or housing neck 30 in no way limits the scope of the end effector 10 as disclosed and claimed herein.

During use, it is contemplated that the end effector 10 will provide a user a more ergonomic and comfortable experience, requiring less effort from the user resulting in a less fatigue during use as compared to the prior art. Additionally, the illustrative embodiments of the end effector 10 may be adjusted for optimal use in an infinite number of applications. Additionally, the locator 28 ensures that the user properly locates the distal end 12*c* of the rivet 12 and creates a uniform nugget as the distal end 12*c* is spread.

During use, forces imparted to the rivet 12 may be transferred to the end effector 10 through the main insert 40. Those forces may travel up the main insert 40 to any intermediate inserts 40*a* and/or end insert 40*b*. Additionally, the annular grooves 44 and annular rings 35 may communicate a portion of these forces to the housing neck 30, housing sections 37, and/or end section 38. A portion of those forces may also be communicated to the housing neck 30, housing sections 37, and/or end section 38 via the interaction between an end section seat 38*a* on either the end insert 40*b* and/or end section 38. The end section seat 38*a*, annular ring(s) 35, cap 39, and/or shell 43 may serve to reduce noise during use, vibrations transferred to the user, and/or forces transferred to the user.

The optimal dimensions and/or configuration of the tip 20, hosing neck, housing section 37, end section, and/or inserts 40, 40*a*, 40*b* will vary from one embodiment of the end effector 10 to the next, and are therefore in no way limiting to the scope thereof. These elements may be formed of any material that is suitable for the application for which the end effector 10 is used. Such materials include but are not limited to metals and their metal alloys, polymeric materials, and/or combinations thereof.

Having described the preferred embodiments, other features, advantages, and/or efficiencies of the end effector 10 will undoubtedly occur to those versed in the art, as will numerous modifications and alterations of the disclosed embodiments and methods, all of which may be achieved without departing from the spirit and scope of the end effector 10 as disclosed and claimed herein. It should be noted that the end effector 10 is not limited to the specific embodiments pictured and described herein, but is intended to apply to all similar apparatuses for mitigating and/or reducing the frequency, intensity, and/or number of vibrations and/or energy transmitted from an end effector 10 to a user during operation of the end effector 10, generally reducing the kinetic energy transmitted to a user during operation of an end effector 10, offering an end effector 10 that may be adapted for use in multiple application, and/or providing an end effector 10 that reduces the likelihood that a rivet 12 is improperly placed and/or modified as the distal end 12*c* of the rivet 12 is spread. Modifications and alterations from the described embodiments will occur to those skilled in the art without departure from the spirit and scope of the end effector 10.

The invention claimed is:

1. An end effector comprising:

a. a housing having a first and second end, wherein said first end has an opening, and wherein said housing is composed of multiple adjacent sections with an end cap;

b. a tip positioned in said opening of said housing, wherein said tip and an interior of said housing form a central bore;

c. at least one insert positioned internal said housing and extending into said central bore formed in said tip.

2. The end effector according to claim 1 wherein at least one annular groove is positioned in an outer circumference of said at least one insert and at least one annular ring is positioned in said at least one annular groove.

3. The end effector according to claim 2 wherein a work piece contact surface is formed at a distal end of said tip.

4. The end effector according to claim 2 wherein at least one insert section seat may be positioned between adjacent said at least one inserts.

5. The end effector according to claim 1 wherein at least one biasing member is positioned adjacent said at least one insert in said housing.

6. The end effector according to claim 5 wherein a work piece contact surface is formed at a distal end of said tip.

7. The end effector according to claim 6 wherein a locator is formed in said tip.

8. The end effector according to claim 5 wherein at least one insert section seat may be positioned between adjacent said at least one inserts.

9. The end effector according to claim 8 wherein said insert section seat is positioned on an axial surface of said at least one insert adjacent said at least one biasing member.

10. The end effector according to claim 1 wherein at least one biasing member is positioned between adjacent sections of at least one insert positioned therein.

11. The end effector according to claim 10 wherein at least one insert section seat may be positioned between adjacent said at least one inserts.

12. The end effector according to claim 11 wherein said insert section seat is positioned on an axial surface of said at least one insert adjacent said at least one biasing member.

13. The end effector according to claim 1 wherein a work piece contact surface is formed at a distal end of said tip.

14. The end effector according to claim 1 wherein at least one insert section seat may be positioned between adjacent said at least one inserts.

* * * * *